US006760972B2

(12) United States Patent
Zifferer

(10) Patent No.: US 6,760,972 B2
(45) **Date of Patent: *Jul. 13, 2004**

(54) APPARATUS AND METHODS FOR FORMING INTERNALLY AND EXTERNALLY TEXTURED TUBING

(75) Inventor: L. Robert Zifferer, Waco, TX (US)

(73) Assignee: Packless Metal Hose, Inc., Waco, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/902,870

(22) Filed: Jul. 10, 2001

(65) Prior Publication Data

US 2002/0033035 A1 Mar. 21, 2002

Related U.S. Application Data

(60) Provisional application No. 60/234,458, filed on Sep. 21, 2000.

(51) Int. Cl.[7] ..... B23P 15/26

(52) U.S. Cl. ..... 29/890.053; 29/890.48; 29/890.049

(58) Field of Search ..... 29/890.03, 890.046, 29/890.048, 890.049, 890.05, 890.053; 72/70, 95, 96, 97, 113, 114

(56) References Cited

U.S. PATENT DOCUMENTS

| | | | | |
|---|---|---|---|---|
| 2,819,632 A | * | 1/1958 | Lyman | 72/107 |
| 3,088,344 A | * | 5/1963 | Glaum | 72/107 |
| 3,847,212 A | * | 11/1974 | Withers et al. | 165/179 |
| 3,906,605 A | | 9/1975 | McLain | |
| 4,248,179 A | | 2/1981 | Bonner | |
| 4,330,036 A | | 5/1982 | Satoh et al. | |
| 4,332,294 A | | 6/1982 | Drefahl et al. | |
| 4,373,366 A | | 2/1983 | Tatsumi | |

(List continued on next page.)

FOREIGN PATENT DOCUMENTS

| | | |
|---|---|---|
| DE | 25 15 312 | 10/1976 |
| EP | 0882 939 | 12/1989 |
| GB | 1 448 901 | 9/1976 |
| JP | 07024522 | 1/1995 |

OTHER PUBLICATIONS

Dictonary definition of "knurl".*

International Search Report for International application No. PCT/US 01/29710, mailed on Apr. 2, 2002.

*Primary Examiner*—I Cuda-Rosenbaum
(74) *Attorney, Agent, or Firm*—Meyertons, Hood, Kivlin, Kowert & Goetzel, P.C.; Eric B. Meyertons

(57) ABSTRACT

A machine may produce a tube having textured internal and external surfaces in a single operation. Inner and outer knurling tools may form the textured surfaces. The texturing of the internal and external surfaces may be helical patterns of ribs and grooves. The height of the ribs formed in the internal and external surfaces may be less than about 35 mils. The angles of the patterns relative to a longitudinal axis of the tube may be less than about 45°. The angle of the helical pattern allows textured tubes to be used as heat exchanger elements wherein flow is directed substantially coaxial to the longitudinal axes of the tubes. The helical pattern formed in the external surface may be oriented in a right hand or left hand helical orientation. Similarly, the helical pattern formed in the internal surface may be oriented in a right hand or left hand orientation.

55 Claims, 9 Drawing Sheets

U.S. PATENT DOCUMENTS 4,377,083 A 3/1983 Shepard et al.
4,425,696 A * 1/1984 Torniainen ..... 72/96
4,437,329 A 3/1984 Geppelt et al.
4,514,997 A 5/1985 Zifferer
4,658,892 A 4/1987 Shinohara et al.
4,660,630 A * 4/1987 Cunningham et al. ..... 165/133
4,729,155 A 3/1988 Cunningham et al.
4,765,058 A * 8/1988 Zohler ..... 29/727
4,866,830 A 9/1989 Zohler
4,921,042 A 5/1990 Zohler
5,092,038 A 3/1992 Geppelt et al.
5,186,252 A 2/1993 Nishizawa et al.
5,251,693 A 10/1993 Zifferer
5,259,448 A 11/1993 Masukawa et al.
5,311,661 A 5/1994 Zifferer
5,388,329 A 2/1995 Randlett et al.
5,409,057 A 4/1995 Zifferer
5,415,225 A 5/1995 Randlett et al.
5,551,504 A 9/1996 Zifferer
5,573,062 A 11/1996 Ooba et al.
5,690,167 A 11/1997 Rieger
5,697,430 A * 12/1997 Thors et al. ..... 165/133
5,761,807 A * 6/1998 Schuez et al. ..... 29/890.048
5,803,128 A 9/1998 Reed
5,813,438 A 9/1998 Reed
5,819,807 A 10/1998 Reed
5,992,199 A * 11/1999 Giannetti ..... 72/108
5,992,512 A 11/1999 Tsuri et al.
5,996,686 A 12/1999 Thors et al.
6,336,501 B1 * 1/2002 Ishikawa et al. ..... 165/133

* cited by examiner

APPARATUS AND METHODS FOR FORMING INTERNALLY AND EXTERNALLY TEXTURED TUBING

PRIORITY CLAIM

This application claims priority to U.S. Provisional Application No. 60/234,458 entitled "Apparatus and Methods For Forming Internally and Externally Textured Tubing," filed Sep. 21, 2000. The above-referenced provisional application is incorporated by reference as if fully set forth herein.

BACKGROUND OF THE INVENTION

1. Field of the Invention

The present invention generally relates to extended surface area tubing. The present invention also generally relates to a machine that produces textured surfaces on both inner and outer surfaces of a tube. The textured surfaces may be patterns of ribs and grooves formed in the inner and outer surfaces of the tube.

2. Description of the Related Art

A heat exchanger tube may be used in a process that transfers heat between a first fluid inside the heat exchanger tube and a second fluid outside of the heat exchanger tube. The efficiency of heat transfer between the first fluid and the second fluid may be a complicated function that depends on the characteristics of the fluids, on the characteristics of the heat exchanger tube, and on the characteristics of fluid movement relative to the heat exchanger tube. The term "fluid" refers to a liquid, a gas, or a combination of a liquid and a gas. A heat exchanger tube may also be used to transfer heat between a fluid and a solid. The solid may be located inside or outside of the tube.

Each end of a tube may be pointed. A pointed tube may have reduced diameter cylindrical portions at each end of the tube that transition to a larger diameter main body section of the tube. A pointed tube may facilitate attachment of the tube to support structures. The support structures may be tube sheets of a heat exchanger. Tube sheets may support several tubes within a shell of a tube-and-shell heat exchanger. Fluid that is directed past outside surfaces of tubes of a tube-and-shell heat exchanger may flow in a direction that is substantially coaxial to a longitudinal axis of the shell of the heat exchanger. Tubes having pointed ends may be easier to position and seal to support structures than are tubes that do not have pointed ends. U.S. Pat. No. 5,311,661, which issued to Zifferer and which is incorporated by reference as if fully set forth herein, describes an apparatus that may be used to form heat exchanger tubes having pointed ends.

It is desirable to maximize the heat transfer rate across a wall of a tube of a heat exchanger. Increasing the surface area of a tube may increase the heat transfer rate across the tube. Also, directing fluid flow past and through a tube in desired fluid flow patterns may increase the heat transfer rate across the tube.

One method of increasing the surface area of a tube is to attach fins to an outer surface of the tube. Fins may be attached to a tube after the tube is formed, or fins may be formed in the outer surface of the tube. Fins may be formed on the outer surface of a tube by a finning tool of a finning machine. A finning tool typically includes three or four disks mounted on an arbor. The disks form a spiraled flight of fins on an outer surface of a tube during use. The fins formed by a finning tool may have heights that are greater than about 30 mils (0.030 inches). Generally, the fins formed by a finning tool are oriented substantially perpendicular to the longitudinal axis of the tube. A small amount of skew from a true perpendicular orientation allows the finning tool to provide a driving force to the tube that moves the tube through the finning machine.

Fins may be oriented substantially perpendicular to a longitudinal axis of the tube, or the fins may be oriented substantially parallel to the longitudinal axis of the tube. Fins on an outer surface of a tube that are substantially perpendicular to a longitudinal axis of the tube may be used in heat transfer applications where fluid flow is directed substantially perpendicular to the longitudinal axis of the tube. Heat exchanger tubes of condensers and evaporators may be finned tubes wherein the fins are oriented substantially perpendicular to longitudinal axes of the tubes. Fins that are oriented substantially parallel to a longitudinal axis of a tube may be used in heat transfer applications where fluid flow is directed substantially coaxial to the longitudinal axis of the tube. Tubes having fins that are oriented substantially parallel to longitudinal axes of the tubes may be used in tube and shell heat exchangers.

Another method of increasing the surface area of a heat exchanger tube is to texture the inner surface of the tube. A knurling tool may be used to form a groove and rib pattern on an inner surface of a tube. The knurling tool may be placed within the tube. Force may be applied to an outer surface of the tube to press the inner surface of the tube against the knurling tool. Pressing the inner surface of the tube against the knurling tool forms a knurl pattern on the inner surface of the tube.

A finning tool and a knurling tool may be used in combination to form a tube that has a finned outer surface and a knurled inner surface. U.S. Pat. No. 4,886,830, which issued to Zohler and which is incorporated by reference as if fully set forth herein, describes a method of forming a tube that has a finned outer surface and a knurled inner surface.

An alternate method of texturing a tube is to form a desired pattern of ribs and grooves on surfaces of a flat metal plate. The plate may then be rolled into a cylindrical shape. A weld may be formed to join the ends of the plate together and form a tube. U.S. Pat. No. 5,388,329, which issued to Randlett et al., describes a method of manufacturing an extended surface heat exchanger tube using a rolled and welded metal plate.

A heat transfer rate across a tube may be increased by directing fluid flow in a desired flow pattern through and by the tube. A desired flow pattern may increase internal mixing of the fluid. A desired flow pattern may promote non-laminar fluid flow of one or both of the heat exchange fluids. In a straight, smooth-walled cylindrical tube, fluid may flow past or through the tube in a laminar flow pattern. Laminar fluid flow may develop a boundary layer at a wall of the heat exchanger tube. The boundary layer may inhibit heat transfer throughout the fluid. Non-laminar fluid flow may minimize the formation of a boundary layer and promote internal mixing of the fluid so that heat transfer takes place throughout the fluid.

One method that may be used to obtain a desired fluid flow pattern is to change the geometrical configuration of the surfaces of a heat exchanger tube. The geometrical configuration of the surfaces of a heat exchanger tube may be changed by texturing the surfaces of the tube. Texturing the surfaces of the tube may increase the heat transfer surface area of the tube and promote internal mixing of fluid that flows through or by the tube.

SUMMARY OF THE INVENTION

Inner and outer surfaces of a tube may be simultaneously textured with a texturing machine. The texturing machine may include an outer knurling device and an inner knurling device. The knurling devices may be used to form grooves in inner and outer surfaces of a tube. The depth of the grooves may be less than about 35 mils (0.035 inches), and are preferably less than about 25 mils. The depth of the grooves may be greater than about 4 mils. The grooves formed in the outer surface of the tube may have a different depth and a different pattern than the grooves formed in the inner surface of the tube. The grooves formed in the surfaces of the tube may increase the surface area of the tube, promote internal mixing of fluid that flows by or through the tube, and inhibit formation of stagnant areas of fluid adjacent to inner and outer surfaces of the tube. The grooves may be formed in a helical pattern about a longitudinal axis of the tube. The angles of the helical patterns formed in the inner and outer surfaces of the tube may be less than about 45° relative to the longitudinal axis of the tube. Angle patterns that are less than about 45° relative to the longitudinal axis of the tube may allow the tube to be used as a heat exchanger element wherein fluid flows by and through the tube in directions that are substantially coaxial with the longitudinal axis of the tube.

Texturing in an outer surface of a tube may be formed in a helical pattern by a texturing machine. An angle of the pattern relative to a longitudinal axis of the tube may be less than 90°, and is preferable less than about 45°. The angle of the pattern relative to a longitudinal axis of the tube may be greater than about 2°. Texturing in an inner surface of the tube may also be formed in a helical pattern. An angle of the inner tube surface pattern relative to a longitudinal axis of the tube may be less than about 90°, and may preferably be between about 5° and 45°. The angle of the inner tube surface pattern relative to a longitudinal axis of the tube may preferably be about 30°.

An embodiment of a texturing machine may be used to form a texturing pattern in an outer surface of a tube that is oriented in an opposite direction to a texturing pattern formed in an inner surface of the tube. For example, a pattern formed in an outer surface of a tube may be a 20° right-hand helical orientation of grooves, while a pattern formed in an inner surface of the tube may be a 30° left-hand helical orientation of grooves. In an alternate embodiment, the angle pattern in the outer tube surface may be formed in a left-hand helical orientation, and the angle pattern in the inner tube surface may be formed in a right-hand helical orientation. The oppositely oriented patterns may cause the formation of a crosshatched pattern in the outer and inner surfaces of the tube. The crosshatched pattern may be a result of grooves being formed in the outer surface when ribs are formed on the inner surface. Similarly, grooves may be formed in the inner surface when ribs are formed on the outer surface. Embodiments of texturing machines may form helical patterns in tubing that are in the same orientation. For example, helical patterns in inner and outer tube surfaces may both be formed in right-hand helical orientations. Helical patterns in inner and outer tube surfaces may also both be formed in left-hand helical orientations.

An outer knurling device of a texturing machine may include one or more knurling tools. In an embodiment, the outer knurling device includes three knurling tools that are offset from each other by 120°. The outer knurling tools may be connected to drive mechanisms. When the drive mechanisms are engaged, the knurling tools rotate. The outer knurling device may also be coupled to a mechanism that brings the knurling tools into contact with a tube. When the knurling tools are brought into contact with a tube and when the drive mechanisms are engaged, the knurling tools rotate and form a helical pattern of grooves in an outer surface of the tube. The rotation of the knurling tools may drive the tube through the texturing machine.

In an embodiment, an angle of each outer knurling tool of a texturing machine may be adjustably positionable relative to a longitudinal axis of a tube positioned within the texturing machine. The outer knurling tools may be angled from about 0.50 to about 4.5° in 0.5° increments. The lower ends of the knurling tools may be positioned close to an exit end of the texturing machine. Each outer knurling tool may be set at the same angle. The set angle of the outer knurling tools may determine the feed rate of a tube through the texturing machine. For a tube that is made of a material that is difficult to work, e.g. titanium or cupro-nickel, a small set angle may be preferred. For a tube that is made of a material that is easy to work, e.g. copper, a larger set angle may be preferred so that there is a higher production rate of textured tubing from the texturing machine.

A tube may be positioned over an inner knurling device. The inner knurling device may be positioned beneath an outer knurling device of a texturing machine. The inner knurling device may be rotatively coupled to a mandrel. When a knurling tool or knurling tools of an outer knurling device are brought into contact with an outer surface of a tube, the outer knurling device may press an inner surface of the tube against the inner knurling device. When a drive mechanism or drive mechanisms of the knurling device are engaged to move the tube through the texturing machine, the inner knurling device forms texturing on the inner surface of the tube as the outer knurling device forms texturing on the outer surface of the tube.

A tube that is to be textured by a texturing machine may be placed over a mandrel of the machine so that a portion of a first end of the tube extends beyond the outer knurling device. The outer knurling device may be pressed against the tube to press an inner surface of the tube against the inner knurling device. A drive or drives may be engaged to move the tube through the machine so that the knurling devices form textured inner and outer tube surfaces. The drive or drives may be disengaged before the outer knurling device reaches a second end of the tube. Placing a portion of the first end of the tube beyond the outer knurling device and disengaging the knurling machine before reaching the second end of the tube leaves un-textured portions of tubing at each end of the tube. Un-textured portions of tube may allow the tube to be easily attached and sealed to support structures, such as tube sheets of a heat exchanger.

Each end of a textured tube may also be pointed by a pointing machine to promote easy attachment of the tube to support structures. To point an end of a tube, the end of the tube may be brought into contact with a tube-pointing die. The tube-pointing die may form a frustro-conical section and a cylindrical section having a reduced diameter at the end of the tube.

An advantage of a texturing machine is that the texturing machine may form a tube having inner and outer textured surfaces in a single operation. The textured surfaces may have increased surface area, and the textured surfaces may promote internal mixing of fluid that flows past the surfaces. Inner and outer textured surfaces may increase the effective heat transfer coefficient of the tube as compared to an un-textured tube of the same diameter.

Another advantage of the texturing machine is that a depth of grooves formed in inner and outer surfaces of a tube may be less than about 35 mils. The depth of the grooves may inhibit formation of stagnant fluid areas adjacent to the inner and outer surfaces of the tube while still promoting internal mixing of fluid flowing by or through the tube.

Another advantage of the texturing machine is that the texturing machine may be used to form texturing patterns having a variety of angle patterns and orientations. Different knurling devices may be installed in the texturing machine to form different patterns and different orientations. The angle of the patterns formed in the inner and outer tube surfaces may be less than about 90° relative to a longitudinal axis of the tube. The angle of the patterns formed in the inner and outer tube surfaces may preferably be less than about 45° relative to the longitudinal axis of the tube to promote efficient heat transfer across the tube when the flow of fluid by and through the tube is directed substantially coaxial to the longitudinal axis of the tube. The texturing machine may be used to form a helical pattern in an outer surface of a tube in a first direction that is opposite in orientation to a helical pattern formed in an inner surface of the tube. Oppositely oriented helical patterns may result in the formation of a crosshatched pattern in the inner and outer surfaces of the tube.

Another advantage of a texturing machine is that the angle of outer knurling tools relative to a longitudinal axis of a tube positioned within the machine may be adjustable. Adjusting the angle of the knurling tools allows a user to control throughput of tubing processed by the texturing machine. The throughput of the machine may be controlled to compensate for differences in hardness and workability of different types of tubing.

Another advantage of a texturing machine is that the texturing machine may leave un-textured portions at each end of the tube. The un-textured portions may allow the tube to be easily attached and sealed to support structures. Also, end portions of a textured tube may be pointed to allow the tube to be easily and conveniently attached and sealed to a support structure. A tube may be sealed to a support structure by a sealing method. The sealing method may be, but is not limited to, welding or application of sealant. Attaching a textured tube that has un-textured ends may be easier to accomplish than attaching a textured tube with textured ends because special procedures do not have to be implemented to ensure that a seal is formed adjacent to all of the grooves and ribs formed in the tube. Other advantages of a texturing machine may include that the texturing machine is sturdy, durable, simple, efficient, reliable and inexpensive; yet the machine is also easy to manufacture, install, maintain and use.

BRIEF DESCRIPTION OF THE DRAWINGS

Further advantages of the present invention will become apparent to those skilled in the art with the benefit of the following detailed description of embodiments and upon reference to the accompanying drawings in which.

Figure 1:
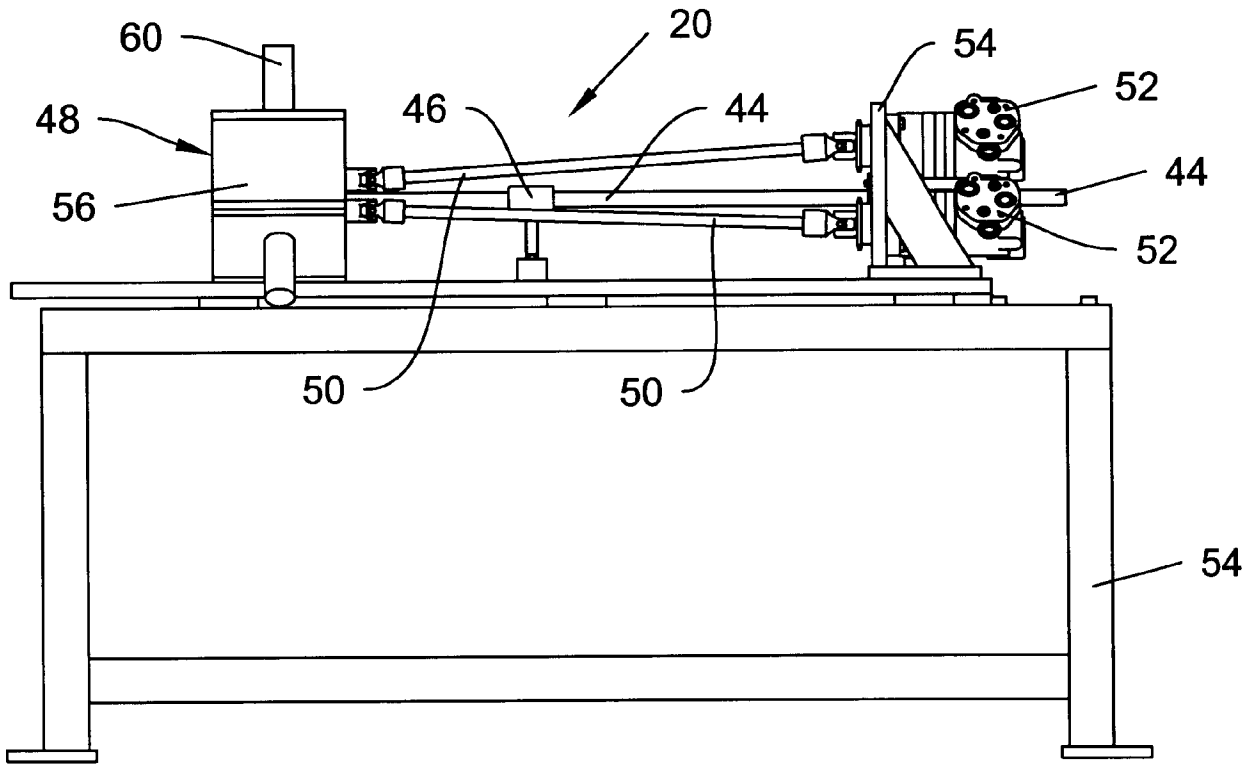
FIG. 1 shows a representation of a front view of an embodiment of a texturing machine.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents and alternatives falling within the spirit and scope of the present invention as defined by the appended claims.

DESCRIPTION OF THE PREFERRED EMBODIMENTS

Figures 2, 3:
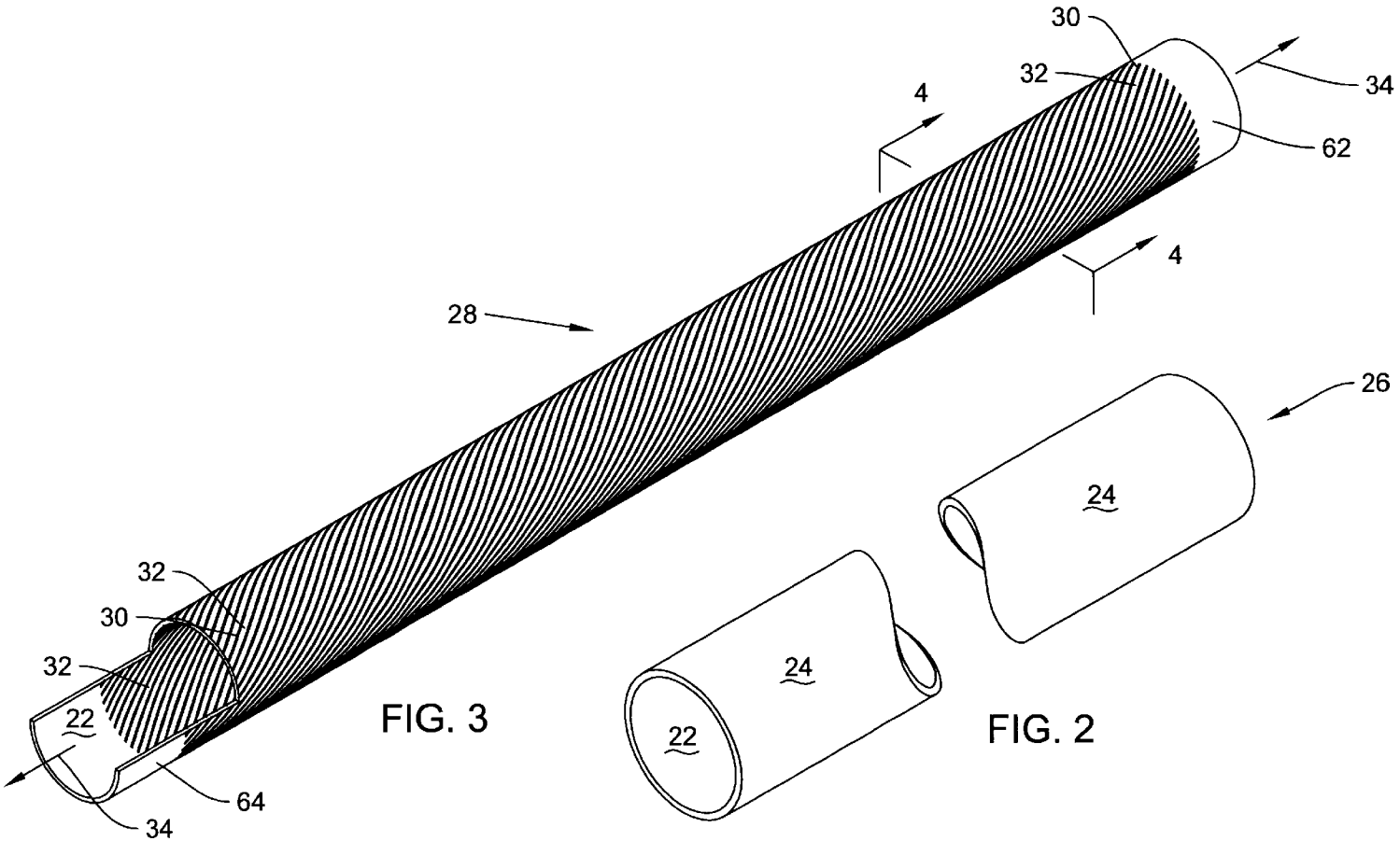
FIG. 2 shows a perspective view of a cylindrical tube that may be used as a blank during formation of a textured tube.
FIG. 3 shows a perspective view of a textured tube, including a cut away portion that shows texturing on an inner surface of the tube.
Figure 4:
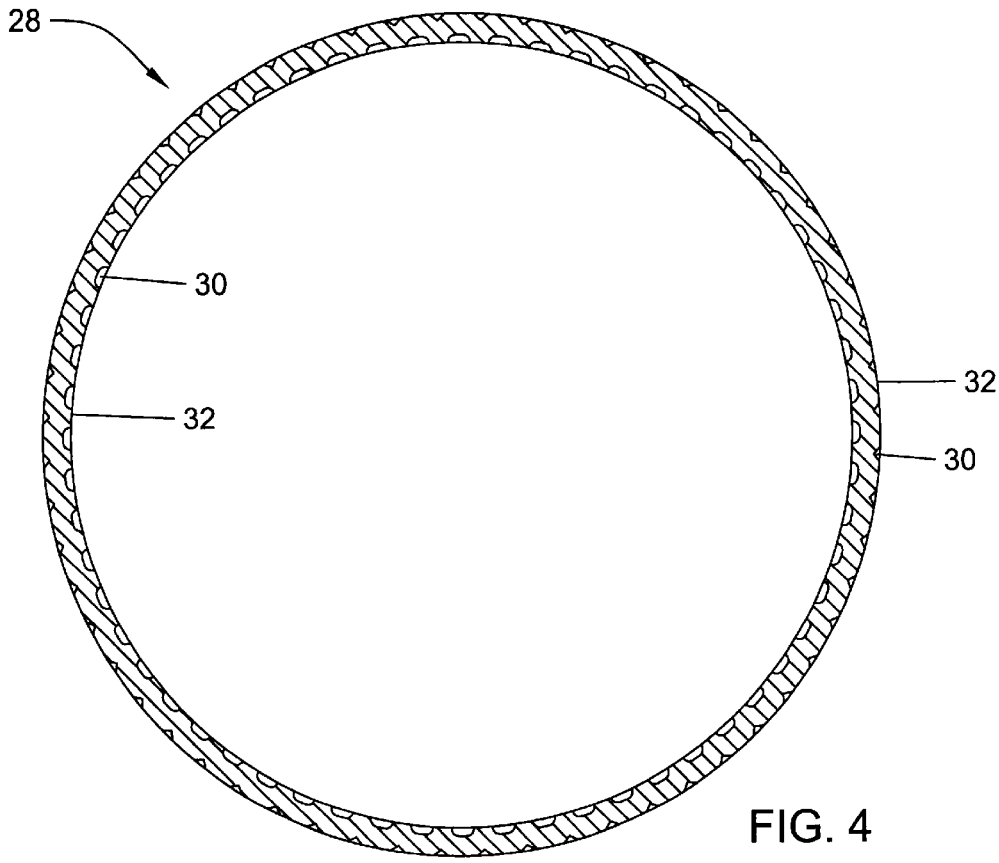
FIG. 4 shows a cross sectional view of the textured tube, taken substantially along plane 4—4 of FIG. 3.

FIG. 1 shows a top view of texturing machine 20. The texturing machine 20 may be used to texture both inner surface 22 and outer surface 24 of a tube 26. FIG. 2 shows a perspective view of a cylindrical tube 26 that may be used as a starting blank for formation of a textured tube 28. FIG. 3 shows a representation of textured tube 28. A portion of the tube 28 is cutaway to show the texturing of the inner surface 22. FIG. 4 shows a cross sectional view of the tube 28.

A texturing machine 20 may form a textured tube 28. Cylindrical tube 26 may be used as a starting material to form a textured tube 28. The cylindrical tube 26 may have an outer diameter that is greater than about ¼ of an inch. In an embodiment, the outer tube diameter of the cylindrical tubing stock 26 is about 1½ inches. Preferably, the cylindrical tube 26 is a metallic tube. In certain embodiments, the cylindrical tubing stock 26 may be made of a high thermal conductivity metal; including, but not limited to, copper, brass, or aluminum. In other embodiments, the cylindrical tubing stock 26 may be made of a corrosion resistant metal; including, but not limited to, stainless steel, titanium, or titanium alloy. Preferably, the cylindrical tube 26 used to form a textured tube 28 has a thin wall thickness. The tubing material may be chosen based upon a number of factors including, but not limited to, material cost, required heat transfer rate across the tubing, and corrosive properties of fluids that contact the tubing. A length of the cylindrical tube 26 may be reduced when the texturing machine 20 forms the tube into a textured tube 28.

A texturing machine 20 may simultaneously texture both an inner surface 22 and an outer surface 24 of a tube 26. The texturing formed in the inner and outer surfaces 22, 24 may be helically formed patterns of grooves 30. Forming a pattern of grooves 30 in the inner and outer surfaces 22, 24 may result in the formation of ribs 32 between adjacent grooves. The angle of the helical pattern of grooves 30 and ribs 32 in the inner surface 22 of a textured tube 28 relative to longitudinal axis 34 of the tube may be less than 90°, and preferably is less than 45°, and most preferably is about 30°. The angle of the helical pattern of grooves 30 and ribs 32 in the inner surface 22 of a textured tube 28 relative to longitudinal axis 34 of the tube may be greater than about 5°. The angle of the helical pattern of grooves 30 and ribs 32 in the outer surface 24 of the tube 28 relative to the longitudinal axis 34 of the tube may be less than 90°, and preferably less than about 45°, and most preferably is less than about 30°. The angle of the helical pattern of grooves 30 and ribs 32 in the outer surface 24 of the tube 28 relative to the longitudinal axis 34 of the tube may be greater than about 2°.

An angle pattern of grooves 30 that is less than about 45° relative to a longitudinal axis 34 of a textured tube 28 may inhibit stagnation of fluid that flows through or by the textured inner and outer surfaces 22, 24 if the flow is directed substantially coaxial to a longitudinal axis 34 of a tube 28. An angle pattern of greater than about 45° may allow the ribs 32 to act as baffles that inhibit fluid through the grooves 30 if the flow is directed substantially coaxial to the longitudinal axis 34 of the tube 28. If the ribs 32 function as baffles, the ribs may allow fluid within the grooves 30 to be substantially immobile or stagnant. The angle pattern of textured inner surface 22 may be substantially the same as the angle pattern formed in textured outer surface 24. Alternately, the angle pattern of textured inner surface 22 may be may be unequal to the angle pattern of outer textured surface 24. For example, the inner surface 22 may have an angle pattern of 30° relative to a longitudinal axis 34 of the tube 28, and the outer surface 24 may have an angle pattern of 20° relative to the longitudinal axis of the tube.

The helical pattern formed by a texturing machine 20 in an inner surface 22 of a tube 26 may be in a right-handed helical orientation or a left-handed helical orientation. Similarly, the helical pattern formed by a texturing machine 20 in an outer surface 24 of a tube 26 may be in a right-handed helical orientation or a left-handed helical orientation. The helical patterns formed in the inner surface and outer surface 22, 24 of a tube 28 may both have the same orientation. For example, the helical pattern formed in the inner and outer surfaces 22, 24 may both have right or left-handed helical orientations. FIG. 3 shows a tube 28 wherein the helical pattern formed in the inner surface 22 and the outer surface 24 of the tube are oriented in the same direction.

Figure 5:
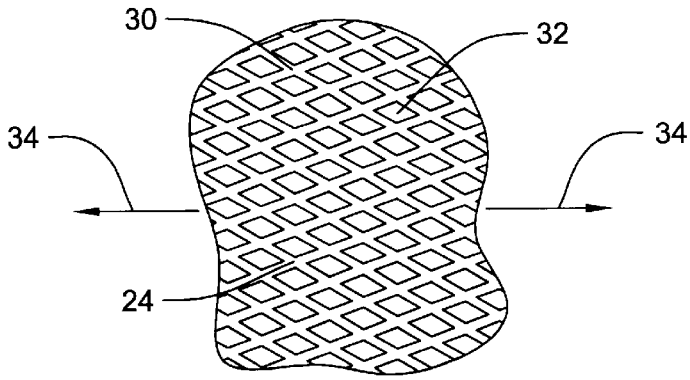
FIG. 5 shows an outside portion of a textured outside surface of a tube wherein the helical pattern formed in the outer surface of the tube is formed in a direction that is opposite to the direction of the helical pattern formed in the inner surface of the tube.

Alternatively, a helical pattern formed in a textured inner surface 22 may be oriented opposite to a helical pattern formed in a textured outer surface 24. For example, the helical orientation of the inner surface 22 may be a right-hand helical orientation while the helical orientation of the outer surface 24 may be a left-hand helical orientation. In an alternate embodiment, the helical orientation of the inner surface 22 may be a left-hand helical orientation while the helical orientation of the outer surface 24 may be a right-hand helical orientation. The opposite helical orientations may produce a crosshatched pattern in the surfaces 22, 24 of the tube 28. FIG. 5 shows a representation of a portion of an outer surface 24 of a tube 28 wherein the texturing machine 20 produced oppositely oriented helical orientations in the inner and outer surfaces 22, 24. The crosshatched pattern may be a result of indirect formation of grooves in the surfaces of the tube 26. Grooves 30 may be indirectly formed in the inner surface 22 when a texturing machine 20 forms ribs 32 on the outer surface 24. Similarly, grooves 30 may be indirectly formed in the outer surface 24 when the texturing machine 20 forms ribs 32 on the inner surface 22. Grooves 30 in a surface that are formed as a result of ribs 32 being formed on an opposite surface may have different depths than grooves that are directly formed in the surface by the texturing machine 20.

A height between a bottom of a groove 30 and a top of a rib 32 of a textured surface 22 or 24 may be less than about 35 mils, may preferably be less than about 25 mils, and may be more preferably be less than about 20 mils. The height between a bottom of a groove 30 and a top of a rib 32 may be greater than about 4 mil. In an embodiment, the height of the ribs 32 formed in the outer surface 24 may be substantially the same as the height of the ribs formed in the inner surface 22. In an alternate embodiment, the height of the ribs 32 formed in the outer surface 24 may be different than the height of the ribs formed in the inner surface 22. For example, FIG. 4 shows an embodiment of a tube 28 wherein the height of the ribs 32 in the outer surface 24 are of a height, which may be about 12 mils, which is different that a height of the ribs formed in the inner surface 22, which may be about 20 mils.

Figure 6:
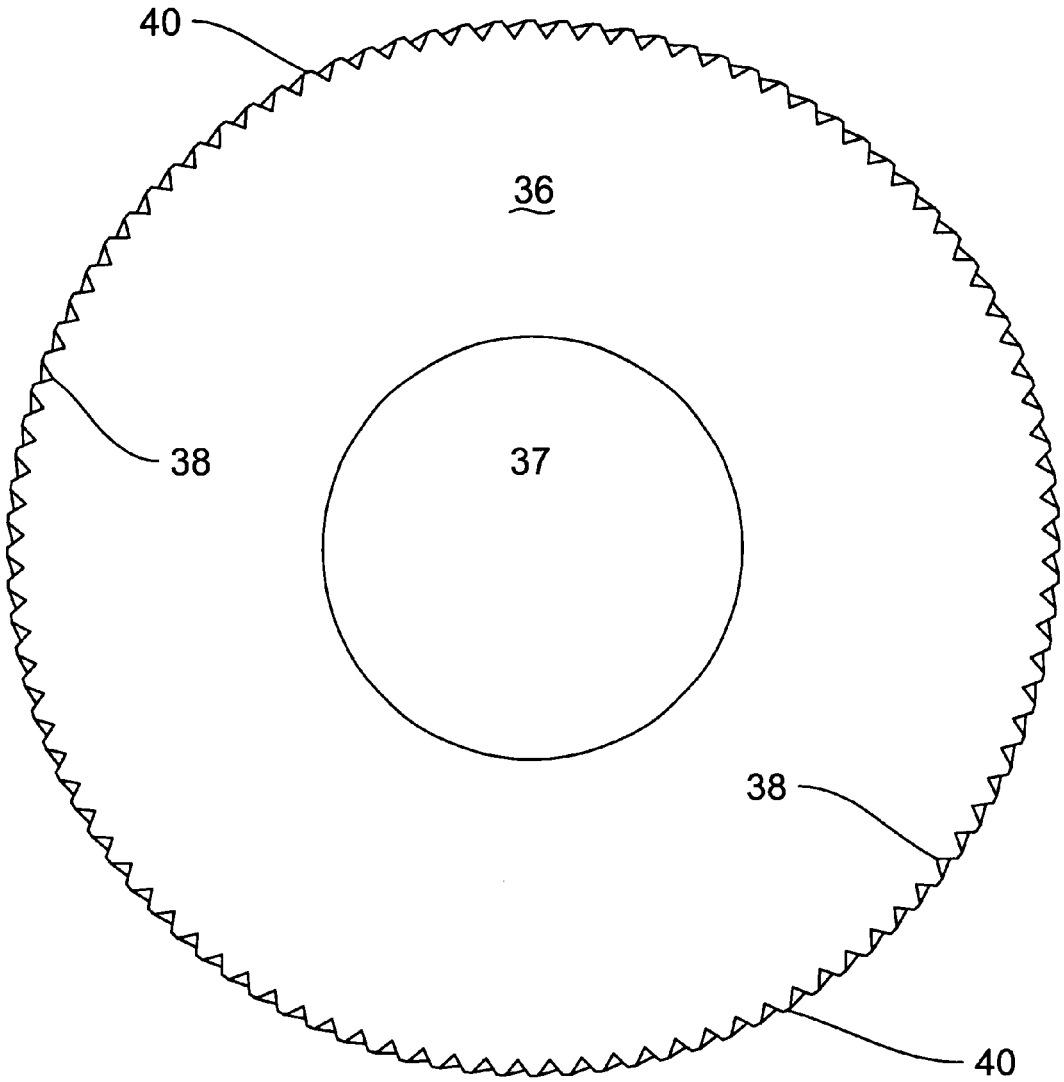
FIG. 6 shows a side view of an embodiment of an inner knurling tool.

A pattern formed in an inner tube surface 22 may be formed by inner knurling tool 36 of a texturing machine 20. FIG. 6 shows a partial representation of a cylindrical inner knurling tool 36. The knurling tool 36 may include bore 37 through longitudinal axis of the cylinder that allows the knurling tool to be coupled to the texturing machine 20.

A pattern formed in the outer surface 24 of a textured tube 28 may be formed by outer knurling tool 42, or by outer knurling tools. An outer knurling tool 42 may substantially resemble an inner knurling tool 36. The geometric properties of the knurling tools 36, 42, such as outer diameter and length, may differ. The knurling tools 36, 42 form ribs 32 and grooves 30 in inner and outer surfaces 22, 24 of the tube 26 in opposite patterns to the patterns of ribs formed in the surfaces of the knurling tools 36, 42. The knurling tools 36, 42 may be made of materials that are harder than the material of the tube 26 being textured. For example, the knurling tools 36, 42 may be formed of C2 carbide and the tube 26 may be formed of copper.

A knurling tool 36 or 42 may include a large number of grooves 38 and ribs 40 on an outer surface of the tool. For example, FIG. 6 depicts grooves 38 and ribs 40 in an inner knurling tool 36. In an embodiment, an inner knurling tool 36 and an outer knurling tool 42 for a 1½" diameter tube 26 each form 80 ribs 32 in the circumference of the tube during texturing. Knurling tools 36 or 42 that form fewer or more ribs 32 in a tube 26 may also be used. Also, a different number of ribs 32 may be formed in an outer surface 24 of a tube 26 than are formed in an inner surface 22 of the tube.

Different knurling tools 36, 42 may be interchangeable positioned within a texturing machine 20. The ability to use different knurling tools 36, 42 within a texturing machine 20 may allow textured tubes 28 to be formed that have different rib heights, different angle patterns, and/or different helical pattern orientations. Tubes 28 with different rib heights, angle patterns, and/or helical pattern orientations may be needed for different heat transfer applications.

The inner knurling tool 36 and the outer knurling tools 42 may be configured to form different types of grooves 30 and ribs 32. For example, in an embodiment of a texturing machine 20, the inner knurling tool 36 may be configured to form substantially "U" shaped grooves 30, while the outer knurling tool 42 may be configured to form substantially "V" shaped grooves. FIG. 4 shows an embodiment of a textured tube 28 wherein the knurling tools 36, 42 formed grooves 30 and ribs 32 of different shapes in the tube.

FIG. 1 shows a representation of a front view of texturing machine 20 that may be used to form a textured tube 28. The machine 20 may include mandrel 44, tube support 46, head 48, drive shafts 50 and drives 52. The machine 20 may also include a cooling system (not shown) that inhibits overheating of the machine and a tube 26 during formation of a textured tube 28. The cooling system may direct a stream of coolant against the tube 26 and portions of the head 48 to cool and lubricate the tube and the machine 20. The coolant may flow by gravity to a collection pan below the head 48.

A mandrel 44 may be a guide and support for a tube 26 that is positioned within a texturing machine 20. A mandrel 44 may be a tube or rod with an inner knurling tool 36 rotatively mounted to the tube or rod near a first end of the mandrel. In an embodiment, the inner knurling tool 36 is not driven, but is free to rotate. In an alternate embodiment, the inner knurling tool 36 may be coupled to a drive mechanism. A second end of the mandrel 44 may be fixedly attached to support structure 54 of the texturing machine 20. The knurling tool 36 may have a diameter that is less than a diameter of the tube 26 to be textured. The mandrel 44 may position the inner knurling tool 36 centrally within the head 48. A user may slide a tube 26 that is to be textured over the inner knurling tool 36 and mandrel 44 so that the knurling tool supports a portion of the weight of the tube. Also, the tube 26 may be partially supported by a tube support 46.

Figure 7:
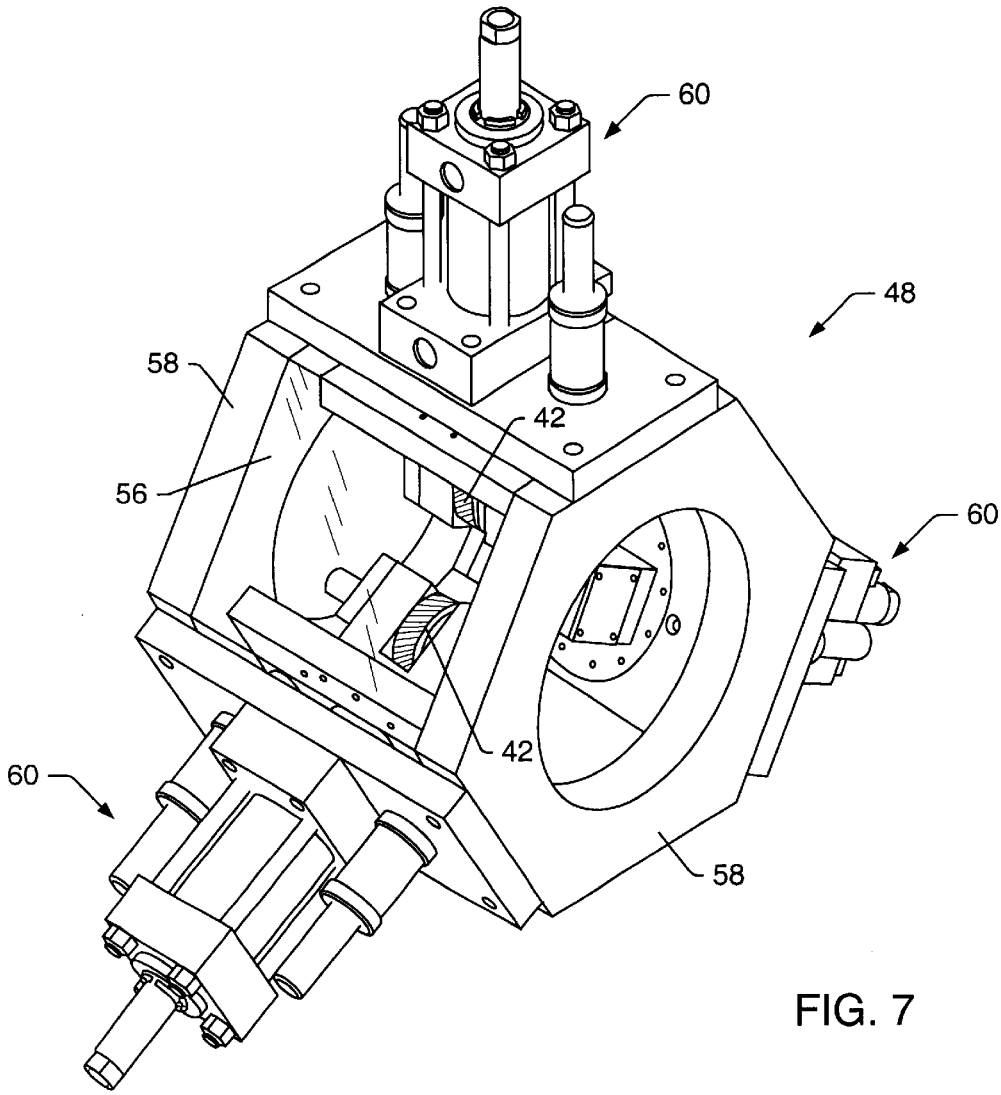
FIG. 7 shows a perspective view of a head of a texturing machine.
Figure 8:
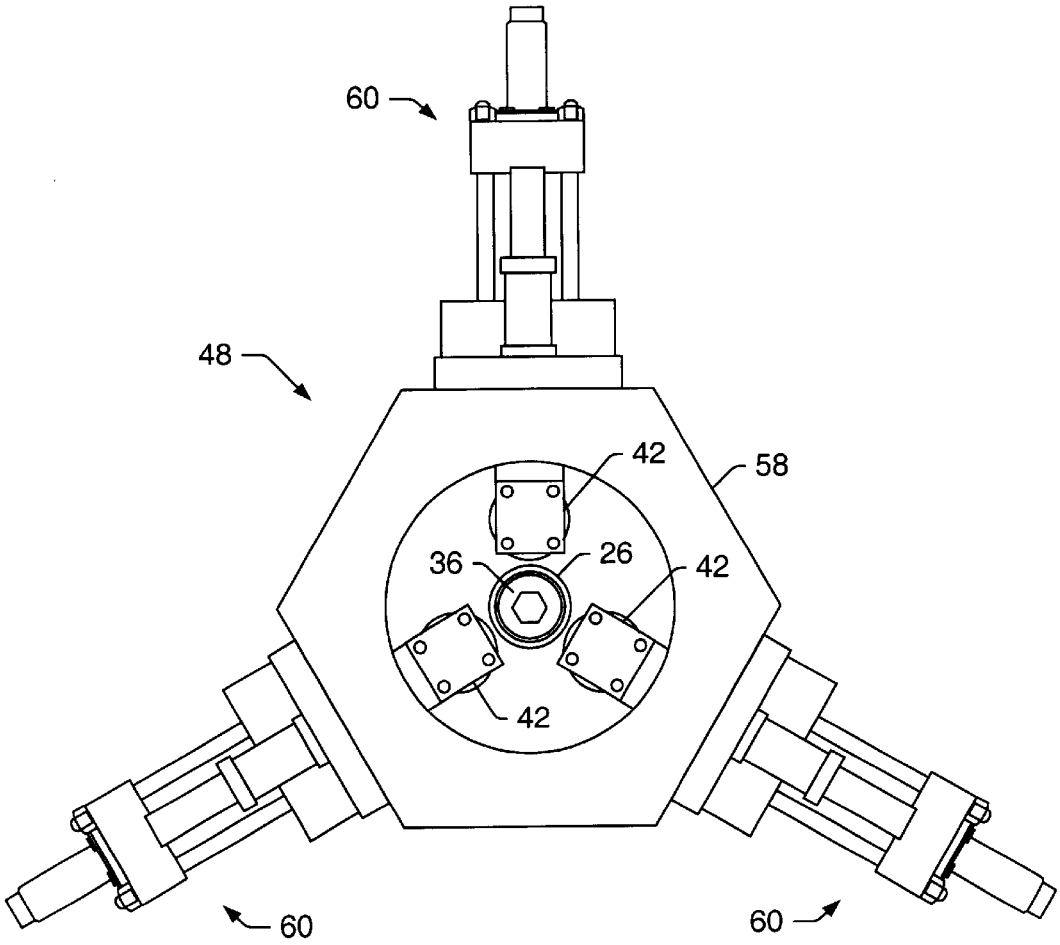
FIG. 8 shows an end view of an embodiment of a head of a texturing machine with a mandrel and tube centrally positioned within the head.

A head 48 of a texturing machine 20 may include covers 56, end plates 58, outer knurling tools 42, and positioners 60. FIG. 7 shows a perspective view of an embodiment of a head 48 of a texturing machine 20. FIG. 8 shows an alternate view of the embodiment of the head 48 of the texturing machine 20 shown in FIG. 7. The covers 56 may be made of polycarbonate, or other transparent material. The covers 56 may allow a user to view the outer knurling tools 42 and the tube 26 during texturing of the tube. The end plates 58 and covers 56 may keep coolant within the head 48 during formation of a textured tube 28. In the embodiment shown in FIGS. 7 and 8, the head 48 includes three outer knurling tools 42 that are offset by 120° relative to each other. Other embodiments may include fewer or more knurling tools 42. The head may include a positioner 60 for each knurling tool 42.

Positioners 60 of a head 48 may adjust the location of outer knurling tools 42 towards or away from a tube 26 centrally positioned within the head 48. In an embodiment, the positioners 60 may include hydraulically operated height adjustment cylinders. The positioners 60 may be independently adjustable so that a distance between each outer knurling tool 42 and a tube 26 centrally positioned within the head 48 may be independently adjusted. The positioners 60 may also be dependently adjustable so that a distance between a tube 26 centrally positioned in the head 48 and each knurling tool 42 may be simultaneously adjusted. When the positioners 60 are in an initial position, the knurling tools 42 may be offset a distance from a tube 26 that is centrally positioned within the head 48. The distance may allow a tube 26 to be inserted onto the mandrel 44. The distance may also allow a textured tube 28 to be removed from the texturing machine 20. When the positioners 60 are engaged, the outer knurling tools 42 may be moved towards the inner knurling tool 36. The positioners 60 may press the outer knurling tools 42 against a tube 26 positioned over the inner knurling tool 36. The positioners 60 may press the knurling tools 42 against the tube 26 with enough force to press an inner surface 22 of the tube 26 against the inner knurling tool 36.

Figure 9:
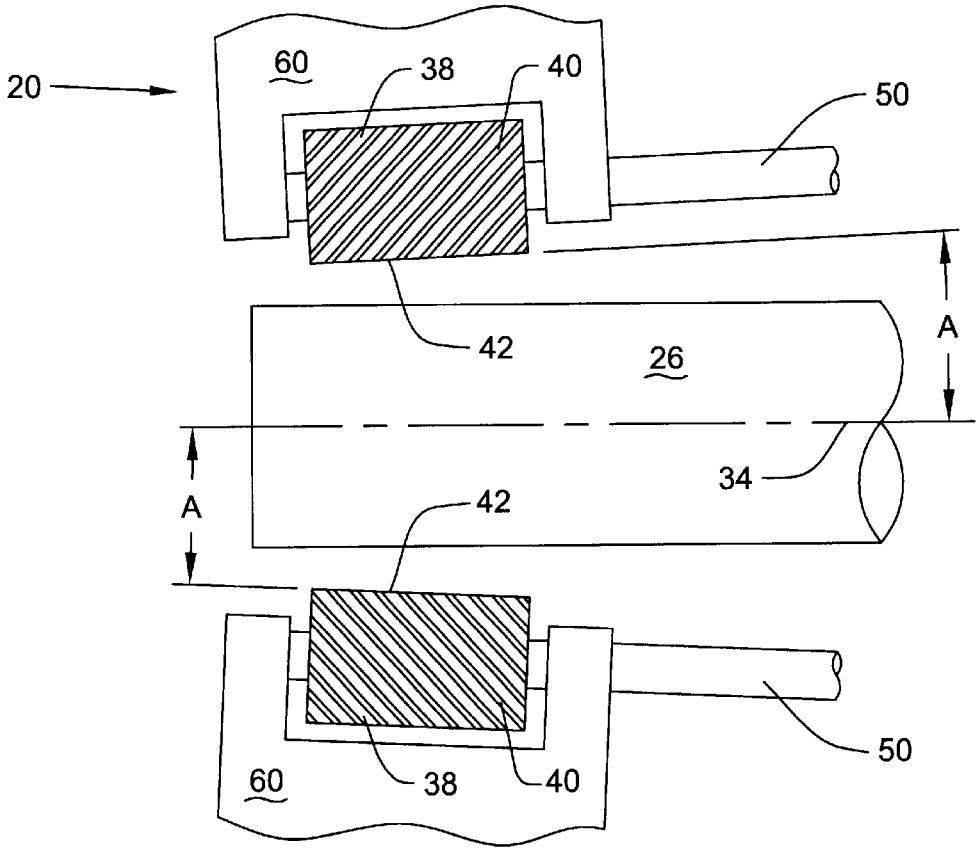
FIG. 9 shows a representation of a portion of an embodiment of a texturing machine with canted or angled outer knurling tools.

Outer knurling tools 42 may be adjustable to establish a set angle of the outer knurling tools relative to a longitudinal axis 34 of a tube 26 positioned within the texturing machine 20. FIG. 9 shows a representation of a portion of a head 48 of a texturing machine wherein the set angle A of the outer knurling tools 42 relative to longitudinal axis 34 of the tube 26 is approximately 2.5°. FIG. 9 shows the portion of the head 48 before the positioners 60 press the knurling tools 42 against the tube 26. In an embodiment, the set angles of outer knurling tools 42 may be adjusted from about 0.5° to about 5° in 0.5° increments. Lower ends of the outer knurling tools 42 relative to the tube 26 are located closer to an exit end of the texturing machine 20. Prior to using the texturing machine 20, each outer knurling tool 42 of the texturing machine may be set at the same set angle. The set angles of the outer knurling tools 42 may be adjusted to control the throughput rate of tubing 26 in the texturing machine 20. A large set angle may allow for a greater throughput than a smaller set angle. The material of the tube 26 may also be taken into consideration when setting the set angle of the outer knurling tools 42. A tube 26 made of a difficult to work material, such as titanium, may need a slow throughput time in the texturing machine 20. The set angle of the outer knurling tools 42 may be adjusted to a small angle for a difficult to work material. A tube 26 made of an easy to work material, such as copper, may be processed at a high throughput rate. The set angle of the outer knurling tools 42 may be adjusted to a large angle for easy to work materials.

A drive shaft 50 may be coupled to each outer knurling tool 42. Each drive shaft 50 may be coupled to a drive 52. In an embodiment, each drive 52 is an electrically operated motor. The drives 52 may be engaged to rotate the drive shafts 50 and the outer knurling tools 42. The rotating outer knurling tools 42 may texture the outer surface 24 of the tube 26 and propel the tube through the texturing machine 20.

Texturing machine 20 may be used to form a textured tube 28. Cylindrical tubing stock 26 may be placed over the inner knurling tool 36 of the mandrel 44. The tube 26 may be pushed down a length of the mandrel 44 so that the tube is supported by the mandrel and by tube support 46. A portion of the tube 26 may extend beyond the inner and outer knurling tools 36, 42. A portion of the tube 26 may be centrally positioned within the head 48. The inner surface 22 and outer surface 24 of the portion of the tube 26 that extend beyond the knurling tools 36, 42 will not be textured by the machine 20. Each outer knurling tool 42 may be adjusted so that outer knurling tools are canted at a desired set angle relative to the longitudinal axis 34 of the tube 26. The drives 52 may be engaged to rotate the outer knurling tools 42. Positioners 60 may be engaged to press the outer knurling tools 42 against the outer surface 24 of the tube 26. Pressing the outer knurling tools 42 against the outer surface 24 of the tube 26 may press the inner surface 22 of the tube against the inner knurling tool 36. Pressing the inner surface 22 of the tube against the inner knurling tool 36 may form grooves 30 and ribs 32 in the inner surface of the tube 26. Pressing the outer knurling tools 42 against the outer surface 24 of the tube 26 may form grooves 30 and ribs 32 in the outer surface of the tube.

The rotating outer knurling tools 42 drive the tube 26 through the head 48 so that texturing is formed on the inner surface 22 and outer surface 24 of the tube. The drives 52 may be disengaged to stop the rotation of the outer knurling tools 42 before the knurling tools texture an end portion of the tube 26. The drives 52 may be disengaged at a point during the formation of a textured tube 28 when a length of an un-textured portion 62 of a first end of the tube is about equal to a length of an un-textured portion 64 of a second end of the tube. The positioners 60 may be disengaged so the positioners return to initial positions. The textured tube 28 may be removed from the texturing machine 20.

Figure 10:
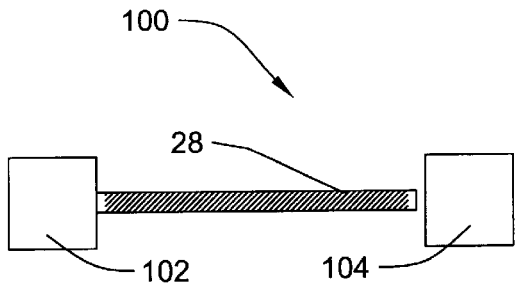
FIG. 10 shows a diagrammatic representation of a tube pointing machine.

After forming textured inner and outer surfaces 22, 24 of a tube 28, the tube may be pointed. FIG. 10 shows a diagrammatic view of tube pointing machine 100. The tube pointing machine 100 may include drive 102 and die housing 104. The drive 102 may push an end of a textured tube 28 against pointing die 106 that is positioned within the die housing 104. The drive 102 may be, but is not limited to, a hydraulic mechanism or a mechanical mechanism that advances the position of the tube 28 longitudinally into the die housing 104. Alternately, the drive 102 may move the die 106 and die housing 104 against the tube 28.

Figure 11:
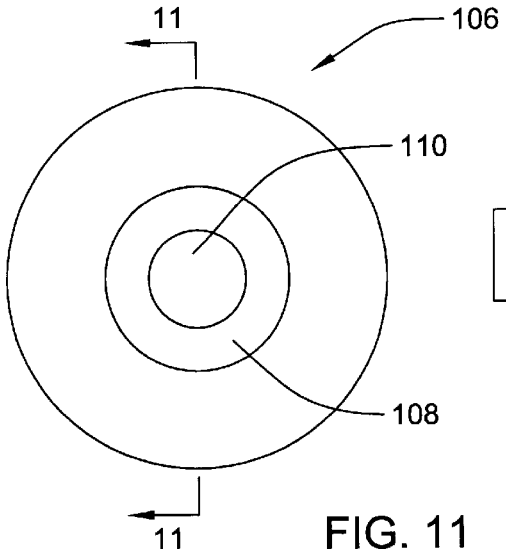
FIG. 11 shows an end view of a tube-pointing die.
Figure 12:
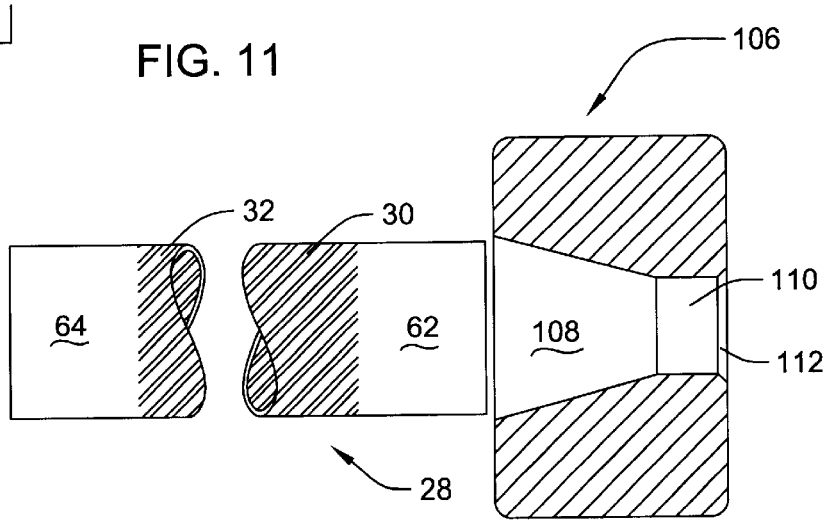
FIG. 12 shows a cross sectional view of a tube-pointing die taken substantially along line 12—12 of FIG. 11 along with a representation of a textured tube.

FIG. 11 shows an end view of pointing die. FIG. 12 shows a cross sectional portion of a pointing die 106. A pointing die 106 may have frustro-conical surface 108 that leads to cylindrical opening 110. The cylindrical opening 110 may include a chamfered rear portion 112. The die 106 may be made of a metal having a hardness greater than the hardness of the tubing 28 to be pointed. For example, stainless steel may be used as a die material for a pointing die 106 that will point a textured copper tube 28.

To point a textured tube 28, an end of the tube and a die 106 are pressed together by a drive 102. The frustro-conical surface 108 of the die 106 may reduce the tube diameter as the tube 28 and die are pressed together. The frustro-conical surface 108 may form frustro-conical portion 66 of textured tube 28 that tapers the tube from a large diameter to a smaller diameter. A leading portion of the tube 28 may be forced into the opening 110 of the die 106. The opening 110 may form cylindrical portions 68 at each end of the tube 28. Each cylindrical portion 68 has a reduced tube diameter as compared to a principal diameter of the tube 28. In an embodiment, the cylindrical portions 68 of the tube 28 are un-textured surfaces. In alternate embodiments, the cylindrical portions 68 may be textured, or partially textured surfaces. The frustro-conical portions 66 of the tube 28 may be textured, partially textured, or un-textured surfaces.

A tube pointer die 106 may be a component of a pointing machine. The pointing machine 100 may be a single-end pointing machine, or a double-end pointing machine. FIG. 10 shows a representation of a single-end pointing machine. In an embodiment of a single-end pointing machine 100, the die 106 may be stationary and an end of a tube 28 may be pressed into the die by the drive 102. In an alternate embodiment of a single-end pointing machine 100, the tube 28 may be stationary and the die 106 may be pressed against an end of the tube. The tube 28 may be repositioned in the single-end pointing machine so that the opposite end of the tube may be pointed.

In an embodiment of a double-end pointing machine, two dies 106 may be separated by a distance that allows a tube 28 to be inserted into the machine 100. The machine may be activated to point the ends of a tube 28 positioned between the two dies 106. In an embodiment, the tube 28 is moved against one of the dies 106 to point the first end, and then against a second die to point the second end. In an alternate embodiment, the tube 28 is stationary, and the dies 106 are moved against the ends of the tube to point the tube. A double-end pointing machine may also be formed wherein one of the dies 106 is stationary, and wherein the other die is moveable. A first end of the tube 28 may be pointed by moving the tube into the stationary die. A second end of the tube 28 may be pointed by moving the moveable die against the second end of the tube.

Figure 13:
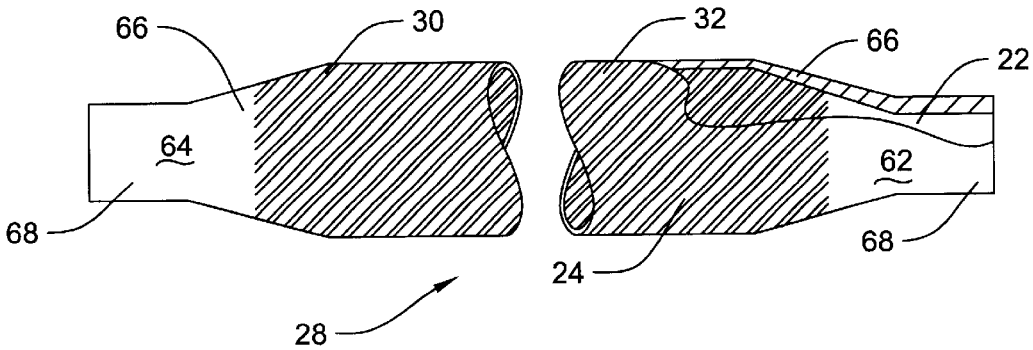
FIG. 13 shows a representation of a pointed tube with a cutout portion that emphasizes the change in wall thickness due to the pointing of the tube.

Pointing a tube 28 may establish a variable wall thickness in the pointed section of the tube. FIG. 13 shows a cross sectional view of an embodiment of a pointed tube 28. A frustro-conical portion 66 of the pointed tube 28 may have a gradually increasing wall thickness. The wall thickness may be least near a large diameter end of the frustro-conical portion 66, and greatest near the reduced diameter cylindrical portion 68. The reduced diameter cylindrical portion 68 may have a substantially constant wall thickness. The wall thickness of the reduced diameter cylindrical portion 68 may be greater than a wall thickness of other portions of the tube 28.

Figure 14:
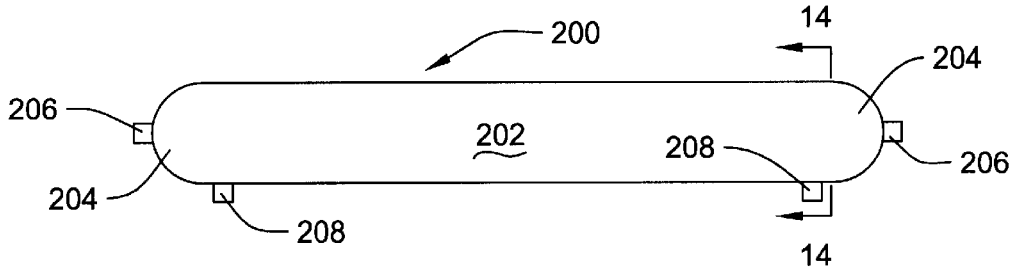
FIG. 14 shows a front view of a heat exchanger.

Un-textured, reduced diameter cylindrical portions 68 may allow several tubes 28 to be closely spaced together within heat exchanger 200. FIG. 14 shows an embodiment of a tube and shell heat exchanger 200. A tube and shell heat exchanger 200 may include shell 202, textured tubes 28, end caps 204, first fluid lines 206, second fluid lines 208, and spacers (not shown). The first fluid lines 206 and the second fluid lines 208 may be input and output lines for heat exchange fluids. The lines 206, 208 may be coupled to heat exchanger fluid lines so that the heat exchanger 200 has a co-current or a counter-current fluid flow arrangement. The type of flow arrangement may be chosen based upon the specific requirements needed for a heat transfer system. Spacers may be positioned between the shell 202 and the tubes 28, and between several adjacent tubes. Spacers positioned between the shell 202 and the tubes 28 may reduce the amount of space between the shell 202 of the heat exchanger 200 and the tubes 28 to inhibit fluid channeling in spaces adjacent to the shell. Spacers positioned between adjacent tubes 28 may reduce the amount of space between the adjacent tubes to inhibit fluid channeling within the spaces.

Figure 15:
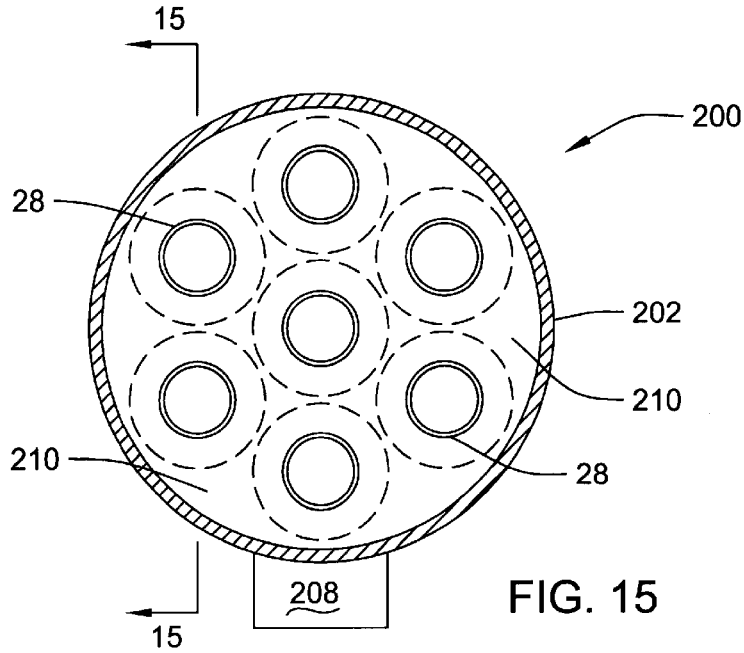
FIG. 15 shows an end view of a heat exchanger with an end cap of the heat exchanger removed from the shell of the heat exchanger to emphasize the tube pattern within the heat exchanger.

Textured tubes 28 may be coupled to support structures 210 within a heat exchanger 200. FIG. 15 shows a sectional view of a tube-in-shell heat exchanger 200 wherein the support structure 210 is a tube sheet. The hidden lines of FIG. 15 represent the unreduced diameter portions of the tubes 28. If the tubes 28 are not pointed, the unreduced diameter portions of the tubes would need to be sealed to the support structure 210. The close spacing of the tubes 28 would not provide much working room to seal the tubes to the support structure 210. Further, if the tube 28 is textured across the entire length of the tube, the texturing may interfere with the formation of seals between the tubes and the support structure 210. The un-textured, reduced diameter cylindrical portions 68 may allow the tubes 28 to be easily sealed to the support structure 210 of the heat exchanger 200. Tubes 28 may be sealed to a support structure 210 by several different methods; including, but not limited to, welding and application of a sealant.

Figure 16:
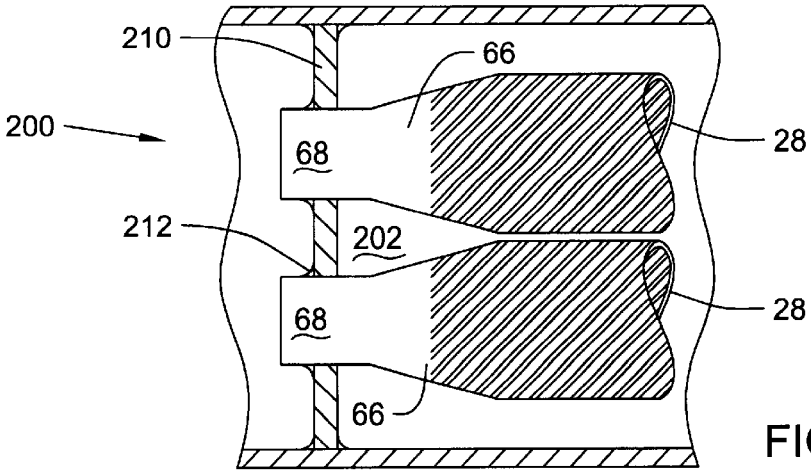
FIG. 16 shows a partial cross sectional view of the heat exchanger taken substantially along line 16—16 of FIG. 15, wherein the textured tubes are not shown in cross section.

FIG. 16 shows a cross sectional view of a portion of a heat exchanger 200. Un-textured, reduced diameter sections 68 of the tubes 28 are sealed to the support structure 210 by welds 212. The increased wall thickness of the un-textured, reduced diameter sections 68 may provide strength and support for the tubes 28 of the heat exchanger 200.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of producing an extended surface area heat exchanger element with a texturing machine, comprising:

forming a helical pattern of grooves in an outer surface of a tube with two or more outer knurling tools radially displaced about the tube;

forming a helical pattern of grooves in an inner surface of the tube with an inner knurling tool simultaneously with the formation of the helical pattern in the outer surface of the tube; and wherein the texturing machine leaves an un-textured surface near a first end of the tube.

2. The method of claim 1, wherein a depth of the grooves formed in the outer surface is less than about 0.035 inches and greater than about 0.004 inches.

3. The method of claim 1, wherein a depth of the grooves formed in the outer surface is less than about 0.025 inches and greater than about 0.004 inches.

4. The method of claim 1, wherein a depth of the grooves formed in the inner surface is less than about 0.035 inches and greater than about 0.004 inches.

5. The method of claim 1, wherein a depth of the grooves formed in the inner surface is less than about 0.025 inches and greater than about 0.004 inches.

6. The method of claim 1, wherein a depth of the grooves formed in the inner surface is less than about 0.020 inches and greater than about 0.004 inches.

7. The method of claim 1, further comprising pointing a first section of the tube near a first end to produce a cylindrical end portion and a reducing taper that transitions a diameter of the tube from a large diameter to a smaller diameter of the cylindrical end portion.

8. The method of claim 7, wherein pointing the first section of the tube comprises forcing the first end of the tube into a tube-pointing die, the tube-pointing die comprising a frustro-conical surface and an end having a cylindrical section configured to form the cylindrical end portion.

9. The method of claim 7, further comprising pointing a second section of the tube near a second end.

10. The method of claim 1, wherein an orientation of the helical pattern in the outer surface is in a right-hand helical orientation.

11. The method of claim 10, wherein an orientation of the helical pattern in the inner surface is in a right-hand helical orientation.

12. The method of claim 10, wherein an orientation of the helical pattern in the inner surface is in a left-hand helical orientation.

13. The method of claim 1, wherein an orientation of the helical pattern in the outer surface is in a left-hand helical orientation.

14. The method of claim 13, wherein an orientation of the helical pattern in the inner surface is in a right-hand helical orientation.

15. The method of claim 13, wherein an orientation of the helical pattern in the inner surface is in a left-hand helical orientation.

16. The method of claim 1, wherein the texturing machine leaves an un-textured surface near a second end of the tube.

17. The method of claim 1, wherein the angle of the pattern in the outer surface is greater than about 2° relative to the longitudinal axis of the tube.

18. The method of claim 1, wherein the angle of the pattern in the inner surface is greater than about 10° relative to the longitudinal axis of the tube.

19. The method of claim 1, wherein the angle of the pattern in the inner surface is about 30° relative to the longitudinal axis of the tube.

20. The method of claim 1, wherein forming the grooves in the inner surface and forming the grooves in the outer surface produces crosshatched texturing in the inner surface and in the outer surface of the tube.

21. The method of claim 1, wherein at least one of the outer knurling tools is configured to be canted at an angle from about 1.5° to about 5° relative to the tube.

22. A method of forming a tube having a textured inner surface and a textured outer surface, comprising:

placing the tube in a texturing machine so that a portion of the inner surface contacts an inner knurling tool;

placing two or more outer knurling tools against an outer surface of the tube to press the inner surface of the tube against the inner knurling tool, wherein the outer knurling tools are radially displaced about the tube;

forming a helical pattern of grooves in the inner surface of the tube, the pattern of grooves corresponding to a pattern of ribs in the inner knurling tool;

forming a helical pattern of grooves in the outer surface of the tube, the pattern of grooves corresponding to a pattern of ribs in the outer knurling tools; and stopping formation of grooves in the outer surface before reaching an end of the tube.

23. The method of claim 22, further comprising canting the outer knurling tools relative to a longitudinal axis of the tube before placing the outer knurling tools against the outer surface of the tube.

24. The method of claim 23, wherein at least one of the outer knurling tools is adjustable relative to the longitudinal axis of the tube in a range from about 1.5° to about 5°.

25. The method of claim 22, wherein a depth of the grooves formed in the inner surface is less than about 0.035 inches.

26. The method of claim 22, wherein a depth of the grooves formed in the inner surface is less than about 0.025 inches.

27. The method of claim 22, wherein a depth of the grooves formed in the inner surface is less than about 0.020 inches.

28. The method of claim 22, wherein an angle of the pattern of grooves formed in the inner surface is less than about 45° with respect to a longitudinal axis of the tube.

29. The method of claim 22, wherein the angle of the pattern of grooves formed in the inner surface is greater than about 10° relative to a longitudinal axis of the tube.

30. The method of claim 22, wherein an angle of the pattern of grooves formed in the inner surface is about 30° with respect to a longitudinal axis of the tube.

31. The method of claim 22, wherein an angle of the pattern of grooves formed in the outer surface is less than about 45° with respect to a longitudinal axis of the tube.

32. The method of claim 22, wherein the angle of the pattern in the outer surface is greater than about 2° relative to the longitudinal axis of the tube.

33. The method of claim 22, wherein placing the outer knurling tools against the outer surface comprises leaving an end portion of the tube beyond a knurling surface of the outer knurling tools so that the end portion will not be textured by the outer knurling tools.

34. The method of claim 22, wherein an orientation of the helical pattern in the outer surface is in a right-hand helical orientation.

35. The method of claim 34, wherein an orientation of the helical pattern in the inner surface is in a right-hand helical orientation.

36. The method of claim 34, wherein an orientation of the helical pattern in the inner surface is in a left-hand helical orientation.

37. The method of claim 22, wherein an orientation of the helical pattern in the outer surface is in a left-hand helical orientation.

38. The method of claim 37, wherein an orientation of the helical pattern in the inner surface is in a right-hand helical orientation.

39. The method of claim 37, wherein an orientation of the helical pattern in the inner surface is in a left-hand helical orientation.

40. The method of claim 22, wherein forming grooves in the inner surface and forming grooves in the outer surface produces a crosshatched texturing pattern in the inner and outer surfaces.

41. The method of claim 22, further comprising forming a reduced diameter cylindrical section at each end of the tube.

42. A method of forming a tube having a textured inner surface and a textured outer surface, comprising:

placing a tube in a texturing machine, so that a portion of the inner surface contacts an inner knurling tool, and wherein the inner knurling tool is rotatively mounted to a mandrel;

placing two or more outer knurling tools against an outer surface of the tube to press the inner surface of the tube against the inner knurling tool, wherein the outer knurling tools are radially displaced about the tube;

forming a helical pattern of grooves in the inner surface of the tube, the pattern of grooves corresponding to a pattern of ribs in the inner knurling tool;

forming a helical pattern of grooves in the outer surface of the tube, the pattern of grooves corresponding to a pattern of ribs in the outer knurling tools; and wherein the texturing machine leaves an un-textured surface near a first end of the tube.

43. The method of claim 42, wherein the mandrel supports a portion of the tube.

44. The method of claim 42, wherein the mandrel is a rod.

45. The method of claim 42, wherein the inner knurling tool is mounted proximate a first end of the mandrel.

46. The method of claim 42, wherein the texturing machine further comprises a drive configured to rotate the outer knurling tool.

47. The method of claim 42, wherein the texturing machine further comprises positioners, and wherein each positioner is configured to adjust the position of one of the outer knurling tools relative to the tube.

48. The method of claim 42, further comprising pointing a first section of the tube near a first end to produce a cylindrical end portion and a reducing taper that transitions a diameter of the tube from a large diameter to a smaller diameter of the cylindrical end portion.

49. The method of claim 42, wherein the texturing machine leaves an un-textured surface near a second end of the tube.

50. The method of claim 42, wherein forming the grooves in the inner surface and forming the grooves in the outer surface produces crosshatched texturing in the inner surface and in the outer surface of the tube.

51. The method of claim 42, further comprising driving the tube through the texturing machine by rotation of the outer knurling tools against the tube.

52. The method of claim 51, wherein at least one of the outer knurling tools is canted at an angle that is greater than about 0.5° and less than about 4.5° relative to a longitudinal axis of the tube.

53. The method of claim 9, wherein pointing the second section of the tube comprises forcing the second end of the tube into a tube-pointing die, the tube-pointing die comprising a frustro-conical surface and an end having a cylindrical section configured to form the cylindrical end portion.

54. The method of claim 22, further comprising pointing a first section of the tube near a first end to produce a cylindrical end portion and a reducing taper that transitions a diameter of the tube from a large diameter to a smaller diameter of the cylindrical end portion.

55. The method of claim 48, further comprising pointing a second section of the tube near a second end to produce a cylindrical end portion and a reducing taper that transitions a diameter of the tube from a large diameter to a smaller diameter of the cylindrical end portion.

* * * * *